US009611686B2

(12) United States Patent
Barnes et al.

(10) Patent No.: US 9,611,686 B2
(45) Date of Patent: Apr. 4, 2017

(54) METHOD AND SYSTEM FOR CASHBOX SECURITY AND MONITORING

(71) Applicant: Trapeze Software ULC, Mississauga (CA)

(72) Inventors: Sharon Ann Irma Barnes, Scottsdale, AZ (US); Marty Charles Brooks, Scottsdale, AZ (US); Angelo David Kachemov, Highland, MD (US)

(73) Assignee: Trapeze Software ULC, Mississauga (CA)

( * ) Notice: Subject to any disclaimer, the term of this patent is extended or adjusted under 35 U.S.C. 154(b) by 46 days.

(21) Appl. No.: 14/673,421

(22) Filed: Mar. 30, 2015

(65) Prior Publication Data

US 2016/0290029 A1 Oct. 6, 2016

(51) Int. Cl.

| | |
|---|---|
| ***G07F 9/06*** | (2006.01) |
| ***E05G 1/10*** | (2006.01) |
| ***E05G 1/00*** | (2006.01) |
| ***G08B 13/22*** | (2006.01) |

(52) U.S. Cl.
CPC ..... *E05G 1/10* (2013.01); *E05G 1/005* (2013.01); *G08B 13/22* (2013.01)

(58) Field of Classification Search
CPC ..... E05G 1/10
USPC ..... 340/542–544
See application file for complete search history.

(56) References Cited

U.S. PATENT DOCUMENTS

| | | | | |
|---|---|---|---|---|
| 2004/0135308 | A1* | 7/2004 | Frank | B65H 31/3009 271/207 |
| 2009/0160646 | A1 | 6/2009 | Mackenzie et al. | |
| 2016/0010384 | A1* | 1/2016 | Zhang | E05G 1/10 235/379 |

* cited by examiner

*Primary Examiner* — Qutbuddin Ghulamali
(74) *Attorney, Agent, or Firm* — Elan IP Inc.

(57) ABSTRACT

There are systems and methods for secure cashbox removal from a transit vehicle and emptying in a vault at a transit site. The cashbox is removably attached to a transit vehicle driven by a transit operator and can be taken to a vault to deposit the cash located in the cashbox. The cashbox has a cashbox tag configured to broadcast a cashbox tag present signal that is received within secure zones and alarm zones, and communicated to a monitoring system to ensure that no cashbox rules are violated in getting the cashbox to the vault for emptying.

21 Claims, 7 Drawing Sheets

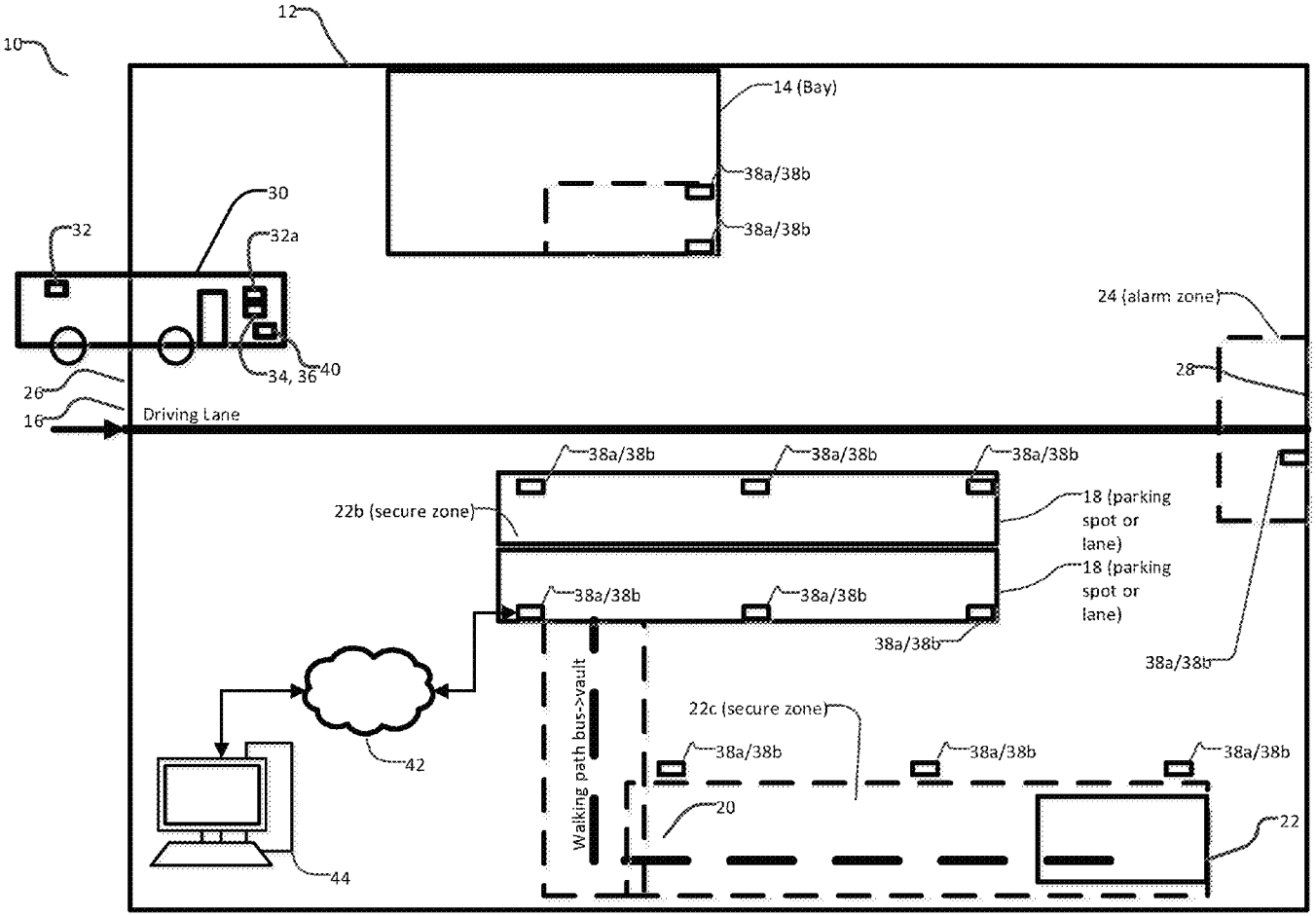
10
12
14 (Bay)
38a/38b
38a/38b
38a/38b

METHOD AND SYSTEM FOR CASHBOX SECURITY AND MONITORING

FIELD OF THE INVENTION

The present invention relates generally to systems and methods for cashbox security. More particularly, the present invention relates to tracking and monitoring cashboxes that are removably located in transit vehicles.

BACKGROUND OF THE INVENTION

Cashboxes are used on transit vehicles to collect fares from riders paying using cash. Cashboxes must be removed from vehicles and deposited, for example in vaults. The safety, monitoring and resetting (to indicate the cash has been removed from the cashbox such that it now contains no cash) of such cashboxes is thus important.

Existing approaches to cashbox safety and security may involve mechanical keys for removing the cashbox, mechanical restraints to tether cashboxes, probes that people handling the cashboxes ("Handlers") may keep that store information about the cashbox and allow removal of the cashbox, depositing, resetting, and the like.

Such systems, however, do not provide adequate flexibility, automation, redundancy, and advanced notice of rogue actions.

There thus remains a need for systems and methods to safely and securely remove cashboxes from transit vehicles and monitor them effectively until their contents are deposited in vaults.

SUMMARY OF THE INVENTION

There is a for secure cashbox removal from a transit vehicle and emptying in a vault at a transit site, the system comprising: a cashbox, removably attached to a transit vehicle driven by a transit operator, that receives cash from one or more riders during operation of the transit vehicle and can be removed from the transit vehicle and taken to a vault to deposit the cash located in the cashbox, the cashbox comprising a cashbox tag configured to: broadcast a cashbox tag present signal; one or more secure zones inside the transit site, created and defined by one or more cashbox signal transceivers, the one or more cashbox signal transceivers defining the secure zones configured to: receive a cashbox tag present signal if the cashbox is within communicable range of the secure zone; and communicate one or more secure zone signals, representing the presence of the cashbox in the secure zone, to the monitoring system if the cashbox tag present signal is received; one or more alarm zones inside the transit site, created and defined by one or more cashbox signal transceivers, the one or more cashbox signal transceivers defining the alarm zones configured to: obtain a cashbox tag present signal if the cashbox is within communicable range of the alarm zone; and provide one or more alarm zone signals, representing the presence of the cashbox in the alarm zone, to the monitoring system if the cashbox tag present signal is obtained; a monitoring system for a transit site, the monitoring system configured to: accept the one or more alarm zone signals and the one or more secure zone signals; determine, using the one or more alarm zone signals and the one or more secure zone signals, whether any cashbox rules have been violated; and trigger a cashbox alarm if any cashbox rules have been violated; and a vault, located at the site, for accepting a deposit of the cash from the cashbox.

The cashbox rules may comprise cashbox tracking rules and cashbox monitoring rules and the cashbox alarms comprise cashbox tracking alarms and cashbox monitoring alarms.

The secure zone signal may include a cashbox signal transceiver identifier and a timestamp of when the cashbox tag present signal was received by the cashbox signal transceiver.

The first secure zone may be a secure pathway and the monitoring system may receive a first set of secure zone signals from the cashbox signal transceivers in the secure pathway as the cashbox is moved towards the vault, and may determine whether any cashbox tracking rules have been violated based on the cashbox signal transceiver identifiers and timestamps of the first set of secure zone signals.

The cashbox tag may further comprise a cash present flag that indicates whether there is cash in the cashbox.

The cash present flag may set to true when cash is received by the cashbox and set to false when a deposit from the cashbox is received by the vault.

The cashbox alarms are deactivated when the cash present flag is set to false.

The cashbox may be removable when one or more cashbox removal conditions are met.

The one or more cashbox removal conditions may comprise: the presence of one or more mechanical keys or one or more electronic keys; the presence of an authorized handler, the cashbox tag does not receive any alarm zone present signal; and the cashbox tag receives at least one secure zone present signal.

The monitoring system may further be configured to: receive the one or more handler signals; determine, using the one or more handler signals, the one or more alarm zone signals, and the one or more secure zone signals, whether any handler rules have been violated; and trigger a handler alarm if any handler rules have been violated.

There is further a method for securely removing a cashbox from a transit vehicle and emptying in a vault at a transit site, the method comprising: removing the cashbox from the transit vehicle; broadcasting a cashbox tag present signal; receiving a cashbox tag present signal if the cashbox is within communicable range of a secure zone; and communicating one or more secure zone signals, representing the presence of the cashbox in the secure zone, to a monitoring system if the cashbox tag present signal is received; obtaining a cashbox tag present signal if the cashbox is within communicable range of an alarm zone; providing one or more alarm zone signals, representing the presence of the cashbox in the alarm zone, to the monitoring system if the cashbox tag present signal is obtained; accepting the one or more alarm zone signals and the one or more secure zone signals; determining, using the one or more alarm zone signals and the one or more secure zone signals, whether any cashbox rules have been violated; and triggering a cashbox alarm if any cashbox rules have been violated.

The cashbox rules may comprise cashbox tracking rules and cashbox monitoring rules and the cashbox alarms comprise cashbox tracking alarms and cashbox monitoring alarms.

The secure zone signal may include a cashbox signal transceiver identifier of a cashbox signal transceiver that received the cashbox tag present signal and a timestamp of when the cashbox tag present signal was received by the cashbox signal transceiver.

The secure zone may be a secure pathway and the one or more secure zone signals may comprise a first set of secure zone signals from the cashbox signal transceivers in the secure pathway as the cashbox is moved towards the vault.

The method may further comprise setting a cash present flag to true when cash is received by the cashbox and to false when a deposit from the cashbox is received by the vault.

The method may further comprise deactivating the cashbox alarms when the cash present flag is set to false.

The removing may further comprise checking that one or more cashbox removal conditions are met. The one or more cashbox removal conditions may comprise: the presence of one or more mechanical keys or one or more electronic keys; the presence of an authorized handler; the cashbox tag does not receive any alarm zone present signal; and the cashbox tag receives at least one secure zone present signal.

The method may further comprise: getting one or more handler signals; deciding, using the one or more handler signals, the one or more alarm zone signals, and the one or more secure zone signals, whether any handler rules have been violated; and raising a handler alarm if any handler rules have been violated.

BRIEF DESCRIPTION OF THE DRAWINGS

Embodiments will now be described, by way of example only, with reference to the attached Figures, wherein:

FIGS. 1*a* and 1*b* show high-level architectures of systems for secure cashbox tracking according to an embodiment of the invention;

DETAILED DESCRIPTION OF THE EMBODIMENTS

Figure 1B:
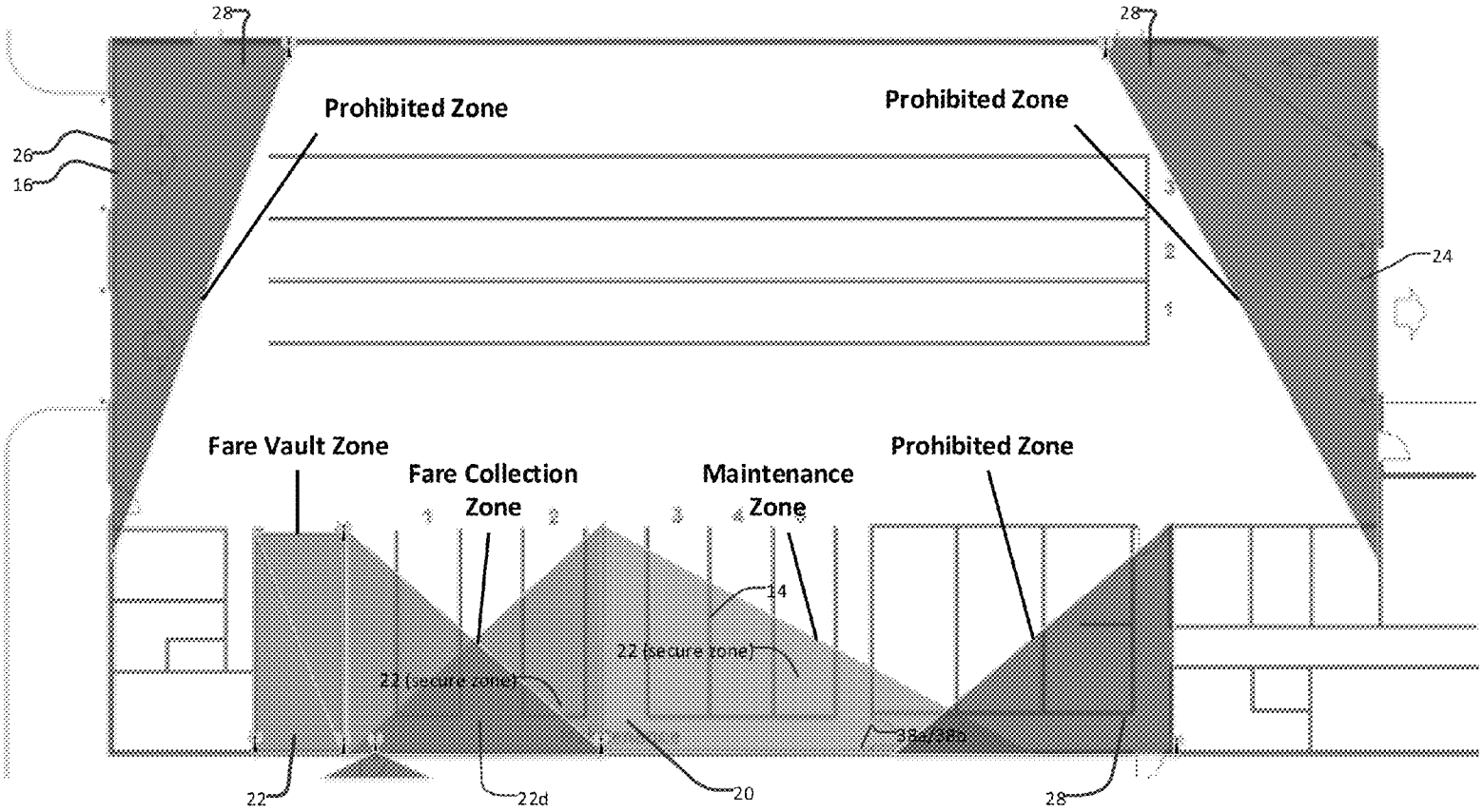

FIG. 1*a* shows a high-level architecture of a system for vehicle locating and sequencing according to an embodiment of the invention comprising system 10 further comprising one or more vehicles (moveable assets) 30, each further comprising mobile data terminal (MDT) 40, tag 32, and farebox 34 comprising cashbox 36, site 12 (having an entrance 26 and an exit 28), further comprising bay 14, one or more driving lanes 16, one or more parking spots 18, one or more secure paths 20 (which may be a particular type of secure zone 22), one or more secure zones 22, one or more reference tags 38*a* or gateways 38*b*, gateways 46, and monitoring system 44, asset 30 further comprising asset tag 32, boundary/parking zone 48, and communication network 42.

System 10 uses one or more gateways 38*b* and reference tags 38*a* to implement various alarms and tracking rules to allow cashbox 36 to be removed from farebox 34 on vehicle 30 and emptied at vault 22 without being stolen. Gateways 38*b* and reference tags 38*a* (each a cashbox signal transceiver or CST) may communicate via RFID with tag 32 that may be part of cashbox 36 to carry out the implementation of cashbox alarms. RFID communication between tag 32, gateways 38*b* and reference tags 38*a* may eventually reach a gateway 38*b* and may be communicated to monitoring system 44, such as via communication network 42. Thus monitoring system 44 may implement the logic of the various cashbox alarms, as described herein—though it is to be understood that such logic, or portions thereof, may be implemented by gateways 38*b*, MDTs 40, or even tags 32 if need be (for example alarm zones may be configured to provide alerts, such as audible alarms, independent of any communication beyond the CST that has identified the cashbox alarm triggering or non-adherence.

Vehicles may enter site 12 via entrance 26 on driving lane 16 and may be destined for one or more of bay 14 or parking spots 18 before being sent back out to perform more work, exiting site 12 via exit 28. Upon entry tag 32 may be registered by a CST so that tag 32 may be triggered to be monitored (though other cashbox monitoring triggers are possible, such as when cashbox 36 is removed from farebox 34). Cashbox 36 may only be removable from farebox 34 if certain cashbox removal conditions are met, as described herein, such as one or more of via a mechanical key, when tag 32 is within one or more secure zones, or the presence of a Handler is detected (such as via a CST on the Handler's person, such as on their mobile phone, badge or MDT 34). Once removed from farebox 34 cashbox 36 may need to i) adhere to one or more cashbox tracking rules to avoid triggering one or more cashbox tracking alarms, ii) adhere to one or more cashbox location rules to avoid triggering one or more cashbox location alarms (such cashbox tracking alarms and cashbox monitoring alarms being referred to herein as cashbox alarms), and handler may need to adhere to one or more handler rules to avoid triggering one or more handler alarms (such as handler may not leave site until cashbox 36 is fully processed and the cash present flag is reset, handler must always be in communicable range of cashbox tag 32, and the like) as described herein. Such cashbox alarms may be initiated or activated whenever cashbox 36 is being monitored or whenever it is removed from farebox 34 or vehicle 30, possibly in conjunction with system 10 knowing that cashbox 36 is not empty (ie it contains cash, such as via a cash present flag being set to true on tag 32, monitoring system 44 or MDT 40). When cashbox 36 is removed from farebox 34 or otherwise prepared to be emptied, it may be taken to a vault for emptying or other processing may occur. During such time it must not set off cashbox alarms; if it (or its handler more accurately) does it may be given time to take corrective action, as described herein, such that the required processing (emptying in vault 22, fixing farebox 34 in bay 14, etc) may be performed.

At a high level, and as further described herein, cashbox 36 may not set off or trigger cashbox alarms if it is located within at least one secure zone 22, is moving through any secure zones that are secure paths (such as secure zone 22*c*) appropriately, not in any alarm zones 24, and following farebox removal rules, cashbox removal rules, handler rules, and cashbox processing rules. Secure zones and alarm zones may be configured (both their number, location and size) in each implementation of system 10. Exemplary secure zones may include: a portion of bay 14, parking spots 18, wash bays, maintenance areas and fueling areas (not shown) and secure pathways to vault (such as secure zone 22*c* demarcated by dashed lines in FIG. 1*a*). Exemplary alarm zones may include: areas near entrances and exits of site 10 (being either vehicle 30 entrances or exits or other entrances and exits), driver change rooms or lunchrooms, areas where cash might fall and be lost, etc.

Cashbox alarms may be deactivated upon one or more deactivation triggers, such as reattaching to farebox 34, emptying its cash at vault 22, and the like. Different cashbox alarms may then be activated for its return to farebox 34 or vehicle 30 returning to perform another run and exiting site 12 via exit 28.

Site 12 may be any location where transit vehicles stop to empty cashboxes 36. Examples may include bus depots, banks, vehicle storage sites, shipping container storage areas (including on ships or on land), and the like. Site 12 may comprise outdoor areas and/or indoor areas in which moveable assets may be placed or kept. In a transit application, for example and as shown in FIG. 1, site 12 may be or include a transit bay 14 where assets 30, potentially transit vehicles, go for maintenance and storage when they are not being used, driving lanes 16, parking lanes 18 (which may be in bay 14, site 12 and may be areas as opposed to spots).

Moveable assets 30 (or simply 'assets' or vehicles) may be vehicles (such as buses, trains, streetcars or fleet vehicles) or other moveable assets. Assets 30 may enter site 12 via entrance 26 and may then be parked in a parking spot 18 or in bay 14 until they exit via exit 28 to perform another run.

Vehicle 30 may comprise mobile data terminal (MDT) 34 thereon or therein, though possibly being removable therefrom. MDT 40 may be computing devices that may take user input (such as keystrokes, clicks, touch inputs, and the like) and provides the user interface to functionality relating to, for example, the provision of transit services, driver or vehicle evaluation, and acceleration monitoring, and interacting with monitoring system 44 and the software located thereon. MDT 40 may have software running thereon to accept inputs as described herein, provide outputs as described herein, and communicate with other elements of system 10 as described herein. MDT 40 may have features of many tablets, smartphones, rugged PCs, and the like, such as one or more screens, memory, processors, cameras, communication modules (Bluetooth, RFID, cellular, WiFi, NFC, etc), and user inputs (touchscreens, buttons, etc). Vehicle 30 may comprise other components and systems (not shown) including, but not limited to, electrical, mechanical and computer systems and sensors, various of such systems requiring or being capable of monitoring.

MDT 34 may be able to communicate with other elements of system 10 to implement aspects of the invention described herein (such as farebox 34, cashbox 36, tags 32, RTs 38*a*, gateways 38*b*, monitoring system 44 and the like), for example by communication network 42, or directly such as may be the case with other systems of vehicle 30. One exemplary MDT 32 may be Ranger 4™, made by Trapeze Software™.

Vehicle 30 may further comprise one or more RFID asset tag 32 (referred to herein interchangeably as "tag 32", "asset tag 32" or "AT 32"), including one or more tags 32*a* located in/on cashbox 36. Tag 32 may communicate via RFID (or similar communication that allows local communication, including in various frequency bands as required) with other assets 30, RTs 38*a*, gateways 38*b*, and monitoring system 44 (that may have or be RT 38*a*).

Tags 32, or cashbox tag 32, may be located thereon or therein, and may be removably attached. Tags 32 may operate in one or more "states" that govern their functioning. Tags 32 may transmit or broadcast a beacon signal (a cashbox tag present signal) for a particular duration (transmission duration) every few seconds (or other transmission interval) and may listen for other signals (such as alarm zone present signal, that may cause local processing on the tag 32 such as enabling a lockout for opening cashbox 32 or removing cashbox 32, or a secure zone present signal) for a particular duration (reception duration) every few seconds (reception interval). The location of asset tag 32 on asset 30 may be used to optimize communication ranges, reduce power consumption, and increase the ease of locating and sequencing (for example, placing tag 32 at the front of asset 30 may be more helpful than placing it somewhere between the front and back; and placing tags 32 at the same general location on each asset may also be assistive). Each asset 30 may have one or more tag 32 (such as the front of asset 30 and at the back of asset 30, on farebox 34 and cashbox 36).

Cashbox tag 32 on a farebox 34 may be able to retrieve and/or determine information relevant to asset 30 (status information), for example its cash holdings (via a cash present flag for example), location or information from other components (not shown) of assets 30, site 12, or gateways 38, for example from one or more sensors, and transmit that information to other assets 30, gateways 38, CSTs, or monitoring system 44 when they are within communicable range, allowing asset 30 to communicate with system 10 (for example providing status information to monitoring system 44) to provide the functionality described herein. ATs 32 (and RTs 38) may comprise a processor, memory or storage, and other features typical of RFID tags and gateways, that may allow accomplishing of functionality described herein.

Parking spots 18 may substantially be any parking spot in site 12. Parking spots 18 may be pre-determined or ad-hoc (for example just being where asset 30 stops), may be part of a parking lane 24 or separate, may be in a bay 14 or anywhere else in site 12. Each parking spot 18 may be uniquely identified or identifiable in monitoring system 44.

Driving lanes 16 may allow assets 30 to be driven through site 12 in order to arrive at a parking spot 20 or exit 28. Driving lanes 16 may have one or more configurations that may be set up, for example, in monitoring system 44.

Reference tag 38 (referred to herein interchangeably as "reference tag 38" or "RT 38") communicates via RFID with other gateways 46 and tags 32. RTs 38 may be similar to ATs 32 but may have permanent power sources and be located in a fixed position in site 12. RT 38 may initiate communication or tag 32 may initiate communication. RTs 38 may be placed throughout site 12 so that they can communicate information with assets 30, and provide/gather information assisting in the processes described herein.

Gateways 46 may be similar to RTs 38 and further able to bridge the communication between RTs 38 and tags 32 into other networks (such as communication network 42)—essentially acting as a gateway between two modes of communication that otherwise may not inter-communicate.

All CSTs (as defined herein) may have identifiers that may be unique to them. Such identifiers may be communicated in various signals and for various purposes, as described herein.

Secure zones 22 may be an area within which cashbox 36 may be allowed to be removed from farebox 34. This area may be defined geographically though practically it may be defined by the communicable ranges of the various CSTs (RTs/gateways 38*a*/38*b*) that create secure zone 22. Once cashbox 36 is within a secure zone 22 it must remain within communicable range of at least one of the secure zone's CSTs for cashbox to be considered in the secure zone. Secure zones may include vaults, pathways, rooms within site 12 (such as a supervisor room), maintenance areas, wash areas, etc. Each CST in a secure zone 22 (or in an alarm zone 24) may receive a cashbox present signal and forward the cashbox present signal, optionally with a timestamp of when such cashbox present signal was received by the particular CST from cashbox 36 (as a secure zone signal or alarm zone signal as applicable) and transmit a CST present signal that may include a CST identifier and may be an alarm zone present signal or a secure zone present signal depending on what zone or area the CST is to define or demark (such signals may be received by cashbox tag 32 and acted upon locally, for example by enabling a mechanical lock if an alarm zone signal present signal is received by cashbox tag 32).

Alarm zones 24 may be an area within which cashbox 36 may not be allowed to be removed from farebox 34. This area may be defined geographically though practically it may be defined by the communicable ranges of the various CSTs (RTs/gateways 38*a*/38*b*) that create alarm zone 24. Once cashbox 36 is within an alarm zone 24 if it remains within communicable range of at least one of the alarm zone's CSTs it remains in the alarm zone. It is to be understood that any elements of system 10 that are called "tags" (such as tag 32, RT 38, and the like) may be tags in the sense that they may generally be able to receive and transmit via RFID. Of course all such elements may simply be readers. Hence tags (such as RT 38 and AT 32) may generically be referred to as nodes, where nodes may be either tags or readers. Also, all of such elements may comprise components as known to those of skill in the art of RFID systems.

Monitoring system 44 may be a component of system 10 that provides functionality described herein, using information obtained from various components in system 10. Monitoring system 44 may compile information from one or more gateways 38*b*, RTs 38*a*, or assets 30, via communication network 42 or RFID, with other information, for use in providing functionality of system 10 and monitoring system 44. Monitoring system 44 may be implemented via one or more pieces of software and may be operated by one or more users. Though it is shown in the figure as one computer, it can be composed of one or more computing and data storage devices and its functionality can be split up across these devices as appropriate. Of course monitoring system 44 may provide functionality not related to monitoring and tracking of cashbox deposits. Monitoring system 44 is shown as within site 10, but may be located anywhere, including remote from site 10 (though possibly still accessible from within site 10). Monitoring system 44 may comprise components as described herein, and may include storage (for example to store data communicated with and between RTs 38 and ATs 32).

Communication network 42 may enable communication of information between various components of system 10 including, but not limited to, RT 38 and monitoring system 44. Communication network 42 allows for a plurality of signals or information to be sent through its network simultaneously. Communication network 42 may be any public or private network, wired or wireless, and may be substantially comprised of one or more networks that may be able to communicate with each other. Communication network 42 may use a variety of mediums, such as cellular and WiFi networks. Communication networks 42 may not be required, for example, if components of system 10, such as RT 38 and monitoring system 44 are able to communicate directly, such as via RFID communications.

Components that communicate wirelessly in system 10, for example tag 32*a*, RT 38*a* and gateway 38*b*, have both a transmission range and a reception range. The transmission range denotes the distance which a component can transmit a signal to any other components within system 100, while the reception range of a component denotes the distance within which the component can hear signals. Components of system 10 are said to be in communicable range of each other when the reception range of a first component overlaps with the transmission range of a second, or the transmission range of the first component overlaps with the reception range of the second. When this is not true, the components are said to be out of communicable range of each other. If the reception ranges of both components overlap with the other component's transmission range, the components are said to be in bi-directional communicable range. Generally, the further two components are from each other, the weaker the signals exchanged may be—allowing gateways 38 and tags 32 to estimate the distance from, and importance, of signals being received. Each of RT 38 and AT 32 can configure their settings and components to adjust the strength of receiving and transmitting abilities, as required by the particular implementation. As such cashbox 36 may be within communicable range of particular tags 32, RTs 38*a* and gateways 38*b* at particular times as it continues to vault 22 and when it moves out of such range (for example if it does not enter within range of the next required zone demarker) then an alarm may be triggered, as described herein.

In one embodiment, as shown in FIG. 1*a*, RTs 38 may be used to create secure zone 22*a* in bay 14 (such that maintenance may be performed, for example 0, to create a secure zone 22*b* around parking spots 18 (such that cashboxes 36 may be moved between parked vehicles and removed and carried out of parking spots 18), to create secure zone 22*c* (such as a secure pathway, such that a handler can walk cashbox 36 to vault 22), to create alarm zones 24 around exit 28 and entrance 26, and to create checkpoints at exit 28 and entrance 26.

In a further embodiment, as shown in FIG. 1*b*, various prohibited or alarm zones 28 may be created (as shown via the triangles) using various CSTs and geographic features of the area or site 12, various secure zones may be created (such as fare vault zone, which may be akin to vault 22, and fare collection zone 22*d* which may be a location that has parking spots 18 for vehicle 30 to pull into for depositing cash, and maintenance or bay 14). Various CSTs may be used to create the triangular areas in FIG. 1*b* (and it is to be understood that various shapes are possible, not just triangles, based on the geography and configuration of such CSTs).

Of course there may be overlap between secure zones, alarm zones and secure pathways (for example in that there may be overlap of the communicable ranges between such zones and cashbox tag 32). The correct interpretation (ie whether the presence of tag 32 in a particular overlap will cause an alarm or not) may be performed by the logic processors, such as monitoring system 44, as described herein.

Figure 2:
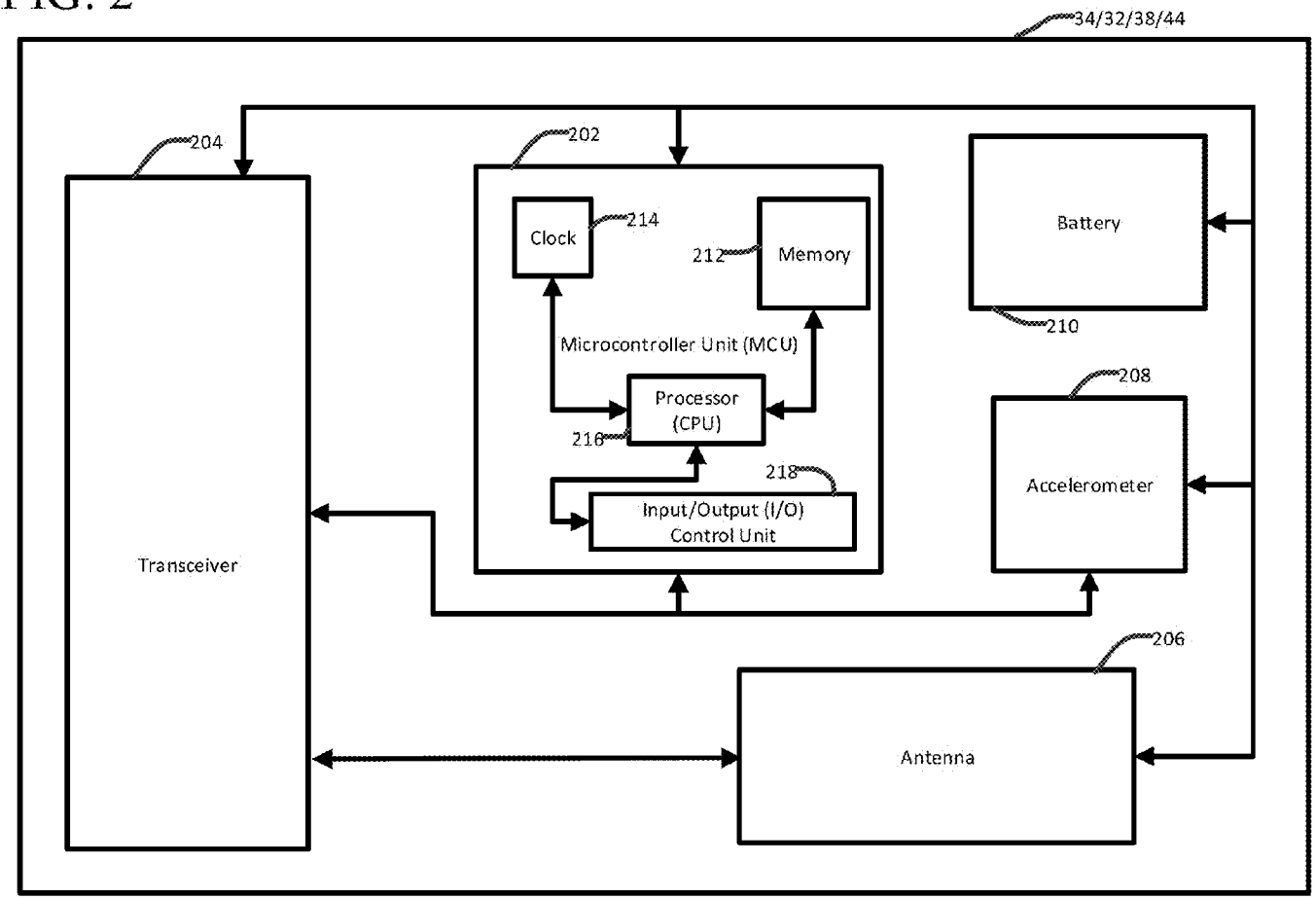
FIG. 2 shows a number of components of aspects of a system for secure cashbox tracking according to an embodiment of the invention.

FIG. 2 shows a number of hardware components of various portions of system 10. Portions of the components shown in FIG. 2 may be part of tag 32, other CSTs, MDT 34 and monitoring system 44. Various CSTs may have some of these components as well, as would be known to those of skill in the art. As shown, monitoring system 44 has a number of components, including a central processing unit ("CPU") 244 (also referred to simply as a "processor"), random access memory ("RAM") 248, an input/output interface 252, a network interface 256, non-volatile storage 260, and a local bus 264 enabling the CPU 244 to communicate with the other components. CPU 244 executes an operating system and programs that provide the desired functionality. RAM 248 provides relatively-responsive volatile storage to CPU 244. The input/output interface 252 allows for input to be received or provided from one or more devices, such as a keyboard, a mouse, a touchscreen, etc., and enables CPU 244 to present output to a user via a monitor, a speaker, a screen, etc. Network interface 256 permits communication with other systems for receiving itinerary planning requests and for providing itinerary responses, in the form of web pages. Non-volatile storage 260 stores the operating system and programs, including computer-executable instructions for itinerary planning. During operation of monitoring system 44, the operating system, the programs and the data may be retrieved from the non-volatile storage 260 and placed in RAM 248 to facilitate execution.

Figure 3:
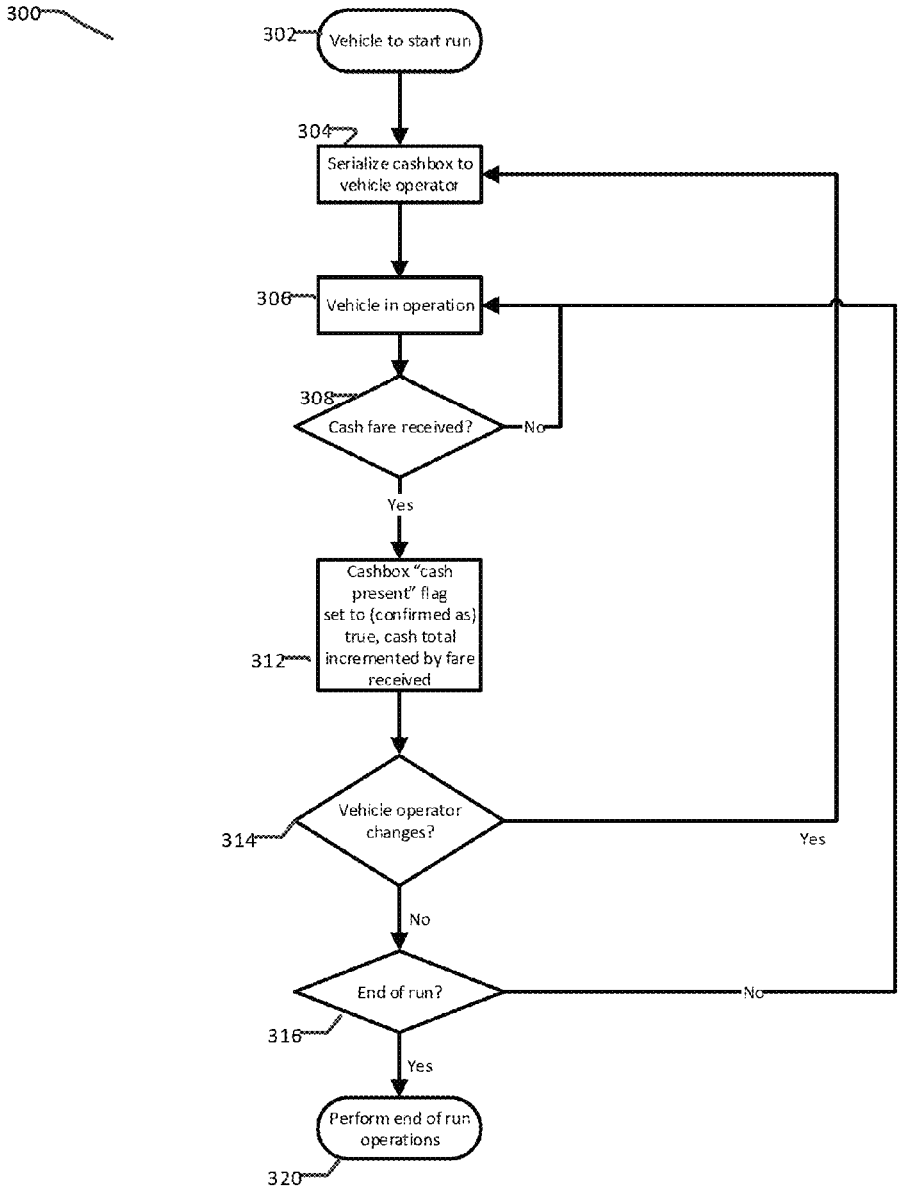
FIG. 3 shows a method for operating a secure cashbox, while a transit vehicle is operating a run, according to an embodiment of the invention.

FIG. 3 shows a method 300 for operating a secure cashbox, while a transit vehicle is operating a run, according to an embodiment of the invention.

Method 300 may be implemented whenever a transit vehicle 30 begins a run (a run beginning when transit vehicle 30 is pulled out of a bay or site and ending when transit vehicle 30 is pulled back into a bay or site, generally having completed part or all of one or more routes). Method 300 may allow a cashbox to properly be assigned to a particular vehicle driver that may perform end of run operations, as described in method 400. Of course it is to be understood that method 400 may be performed by users other than the driver/operator of transit vehicle 30 and may thus be considered a separate method from method 300, or a combined method with method 400.

Method 300 begins at 302 where transit vehicle 30 is to start a run. At 302 transit vehicle 30 may be in site 12 or other parking or storage facility.

At 304 cashbox 36 is serialized or associated to the vehicle operator of transit vehicle 30. This may involve, for example, the vehicle operator logging into MDT 32, which may already be associated with farebox 34 and hence cashbox 36. In particular, serializing may involve storing an operator ID, which may be unique for each authorized operator, with a farebox 34 or cashbox 36 or transit vehicle 30 ID (all of which may be unique for the farebox/cashbox/vehicle). Such pairing (of operator ID with another ID) may be stored in memory of one or more of non-volatile storage 260, RAM 248 of vehicle 30, cashbox 36, tags, and/or other components of system 10.

At 306 transit vehicle 30 may be in operation, driving routes, picking up passengers, and the like.

Each time a new passenger boards, they may pay their fare. At 308 a query is made whether any cash fare is received. This query may be made by farebox 34 and/or MDT 32, alone or in combination. If no cash fare is received then for the purpose of method 300 the method returns to 306 (for example if no cash enters into cashbox 36 then method 300 may simply return to normal 'vehicle in operation' status at 306). If cash is received at 308 then the cash will enter cashbox 36, via entry into farebox 34 (as is known in the art of fareboxes) and method 300 will continue to 312.

At 312 steps may be performed to acknowledge that cash has been input into cashbox 36, such as setting a "cash present" flag in software on MDT or in memory of farebox 34 as applicable (noting that such flag may be "set" the first time cash is deposited, and subsequent cash deposits, before a resetting of such flag, may simply be to confirm the "cash present" flag is set to "true"). Farebox 34 may also increment the cash total contained within cashbox 36 such that an accurate cash amount or cash balance in cashbox 36 is maintained). Note that such data (the cash present flag, cash total, and the like) may be stored, for example, within memory/databases on MDT 32. Of course MDT 32 may not be required in some embodiments of the invention and thus such cash present flag may be stored elsewhere within an exemplary system 10 that does not include MDT 32—such as on tag 32*a*, which could then communicate the status of such cash present flag throughout system 10, such as to monitoring system 44, to allow proper operation thereof. In such case cashbox 36 may reset the flag, possibly at the direction or upon confirmation from another aspect of system 10 such as vault 22.

At 314 a query is made whether a vehicle operator change has occurred. Of course if a vehicle operator changes then the previous vehicle operator need not continue to be responsible for the cash in cashbox 36, such that method 300 proceeds to 304 to re-serialize cashbox 36 with the new vehicle operator. If, at 314, there is no vehicle operator change then at 316 a query is made whether an end of run has occurred (which may indicate that a deposit of money in cashbox 36 into vault 22 is to occur). If so, end of run operations are performed (which may include method 400). If not, then method 300 continues at 306.

Figure 4:
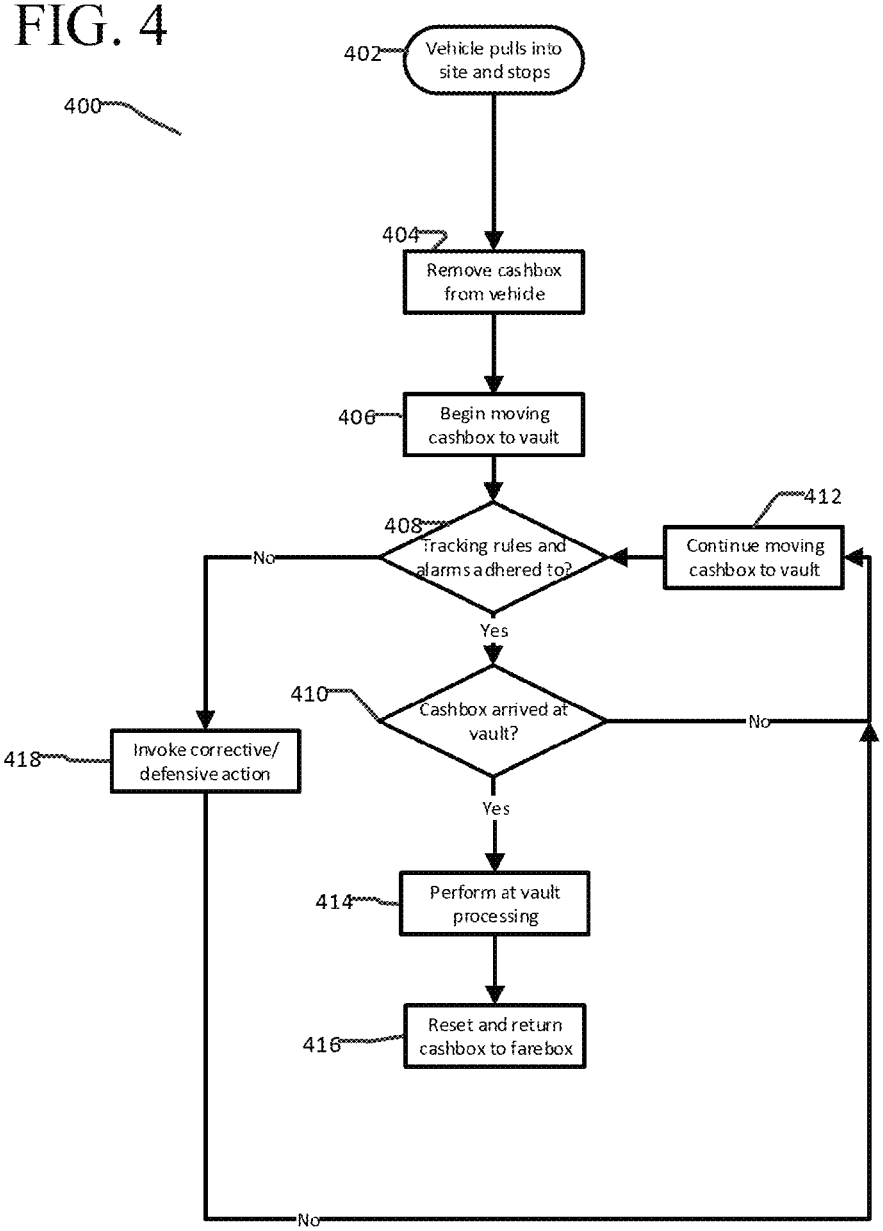
FIG. 4 shows a method for operating a secure cashbox, when emptying a cashbox into a vault, according to an embodiment of the invention.

FIG. 4 shows a method 400 for operating a secure cashbox 36, when emptying a cashbox into vault 22, according to an embodiment of the invention.

Method 400 may be performed whenever cashbox 36 is to be emptied, which may generally be when transit vehicle 30 is pulled into a site and stops, for example at the end of a run. Method 400 may allow an operator of transit vehicle 30 or other handler to safely get cash from cashbox 36 from transit vehicle 30 into a vault or other deposit facility in a secure and traceable manner, and allow any disturbances to be addressed. Of course method 400 may be performed at all times so that cashbox 36 is not removed when it is not supposed to be (or noticed and dealt with if it is removed at such a time).

Method 400 begins at 402 with transit vehicle 30 pulling in to site 12 (such as on driving lane 14 entering entrance 26) or otherwise being prepared for cashbox 36 to be emptied. Then at 404 cashbox 36 is removed from transit vehicle 30 and farebox 34; if successfully removed then it ought to have been removed by an authorized depositor of cash or handler within cashbox 36. Aspects of 404 are described in method 500 but may involve one or more of mechanical keys, software keys that unlock mechanical aspects of farebox 34, RFID based keys, and the like.

At 406 cashbox 36 has been removed from farebox 34 and transit vehicle 30 by a valid or authenticated depositor or handler; cashbox 36 begins its journey to vault 22—such as by first exiting transit vehicle 30. Exiting from transit vehicle may be determining via one or more RTs 38 located at the doors of transit vehicle 30. Such exiting may trigger method 400 to enable tracking rules and alarms referred to herein.

It is to be understood, with respect to 406/408/410/412/418, that such processes may continue until cashbox 36 arrives at vault 22 or some other final intervention or outcome is achieved (such as cashbox 36 being return to transit vehicle 30, cashbox 36 being lost or leaving site 12 without approval, etc).

At 408 tracking rules and alarms (cashbox alarms) are monitored to see if any rules are not being adhered to and alarms are being triggered. Exemplary tracking rules and alarms may include timers (for example for cashbox 36 to reach vault 22 or one or more checkpoints along a secure pathway or secure zones 24), being in safe or secure zones 24 (where cashboxes 36 may be found separate from transit vehicle 30 and/or farebox 34), being in alarm zones 24 (where an alarm will be triggered if cashbox 36 is located therein), crossing alarm checkpoints (such as near exits 16 to ensure cashboxes do not leave an exit 28) and following defined paths 20 (ie being detected by or in communicable range of the proper next CST after, or simultaneously with, being in communicable range with a current CST, where secure zones along defined path 20 may be demarcated by hashed lines 46). Tracking rules and alarms are described in more detail in method 600.

If, at 408, an adherence is returned (no alarms were triggered, or rules violated) then method 400 continues at 410 to query whether cashbox 36 is at vault 22. If it is then method 400 continues to 414 to perform 'at vault processing'. Cash vault processing may involve, for example, putting cashbox 36 into vault 22 where a process is invoked to safely remove the cash from the cashbox. This typically involves locking the cashbox into an apparatus where the door is opened and the cash extracted. In some cases this is a fully automated process, others involve a mechanical lock and lever mechanism operated by a person and some may involve an accountant or some certified person who has a key to open the cashbox and extract money. For the present invention it may be most important to confirm that cashbox 36 has been delivered either to the correct area or locked into vault 22 and that the cash was removed, the latter being triggered by an event of some sort. The event may be a user identifying themselves and saying that they are the one who removed the cash, a message from an external system, or part of system 10 that tells that the cash was removed, a sensor that detects that the vault mechanism was engaged while the cashbox was in the vault, and the like. In one embodiment vault 22 may have coin and/or bill counters (not shown—referred to as a vault fare deposit counter) and a tag. The vault fare deposit counter may count the fare deposited by a particular cashbox 36 (cashbox deposit amount). This counted amount may then be compared to the cash balance (as determined by, and optionally stored memory in, cashbox 36) to determine that the right amount of cash was deposited in vault 22 from cashbox 36. Such comparison may be made between tag 32 in vault 22 and tag 32*a*, or via providing cash balances and cashbox deposit amounts to other elements of system 10 and allowing such comparisons. In any event, confirming the right amount was deposited may be required to continue in method 400. System 10 could also identify cashbox 36 being in vault 22 and assuming that the box was emptied.

At 416 cashbox 36 is reset (which may be part of 'at vault processing') and at some point it is returned to farebox 34.

If at 408 no adherence is returned then method 400 continues at 418 to invoke corrective or defensive actions (that may depend on the alarm or trigger that caused the non-adherence) in hopes that cashbox 36 will return to adherence and continue to move towards vault 22.

Figure 5:
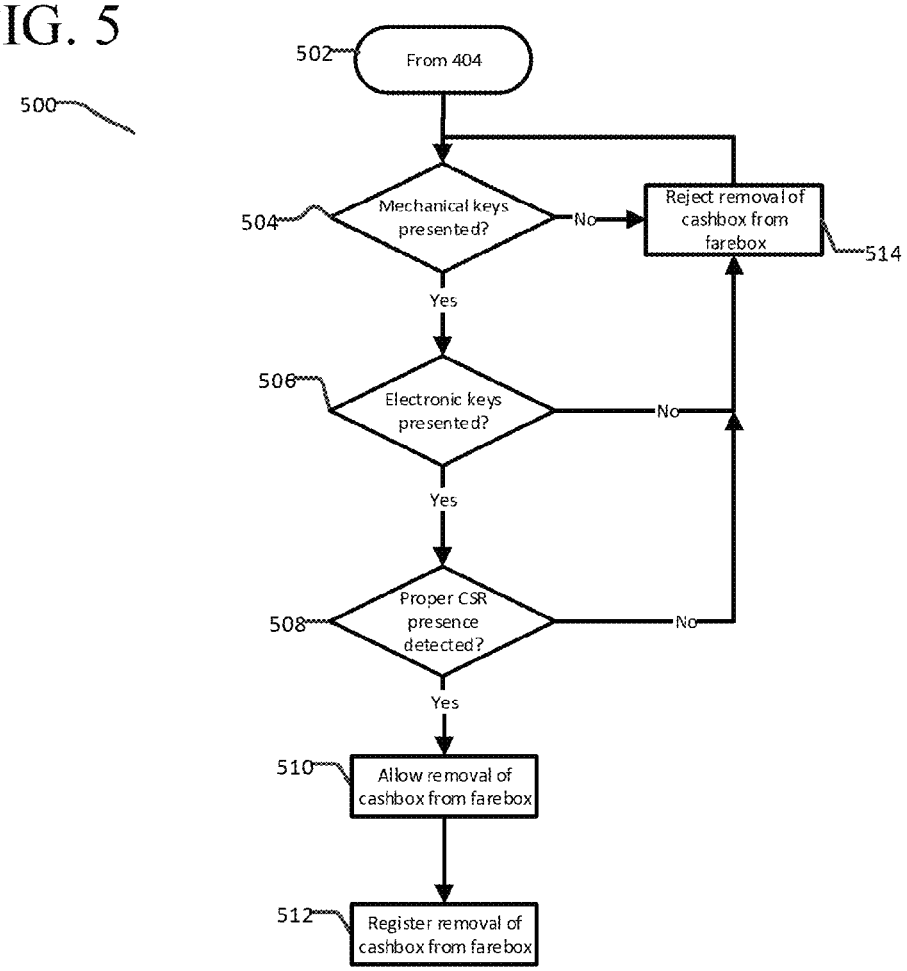
FIG. 5 shows a method for removing a cashbox from a transit vehicle according to an embodiment of the invention.

FIG. 5 shows a method 500 for removing a cashbox from a transit vehicle according to an embodiment of the invention.

Method 500 may use any number or combination of mechanical keys, electronic keys and CST or RFID based keys.

Method 500 begins at 504 to query whether there are any mechanical keys required. These may be standard mechanical keys as are known in the art.

If mechanical keys are required and presented method 500 proceeds to 506 to query for electronic keys. These may include PINs or passwords that may be typed into farebox 34 and/or MDT 40, a card swiped through a card reader either separate from or integrated into farebox 36, or the like. These may be particular to a Handler, a vehicle 30, a farebox 34 or a cashbox 36.

If electronic keys are required and presented method 500 proceeds to 508 to query for the proper presence of one or more CSTs. These may include CSTs in a secure zone or pathway, having passed a CST at entrance 26 to site 12, lack of presence of alarms, and presence of Handler CSTs, for example.

If proper CST presence is detected then method 500 proceeds to 510 to allow removal of the cashbox 36 and the Handler physically removes it. Registration of the removal then occurs at 512, for example by CSTs passing such event to monitoring system 44 and/or MDT 40. This may trigger tag 32*a* to be monitored.

Returning to any of 504/506/508, if such type of key or presence is not required method 500 may proceed via the "yes" path. Otherwise method 500 may proceed to 514 where removal of cashbox 36 is prevented. This may lead to method 500 terminating or simply waiting for the required keys/presence to eventually be presented.

Of course it is to be understood that other aspects of system 10 may be used to ensure only timely removal of cashbox 36 occurs. For example, i) if maintenance is to be performed then proper presence of (or confirmation of) the proper parts may be required, ii) if no cash is present removal may be rejected, and the like.

Figure 6:
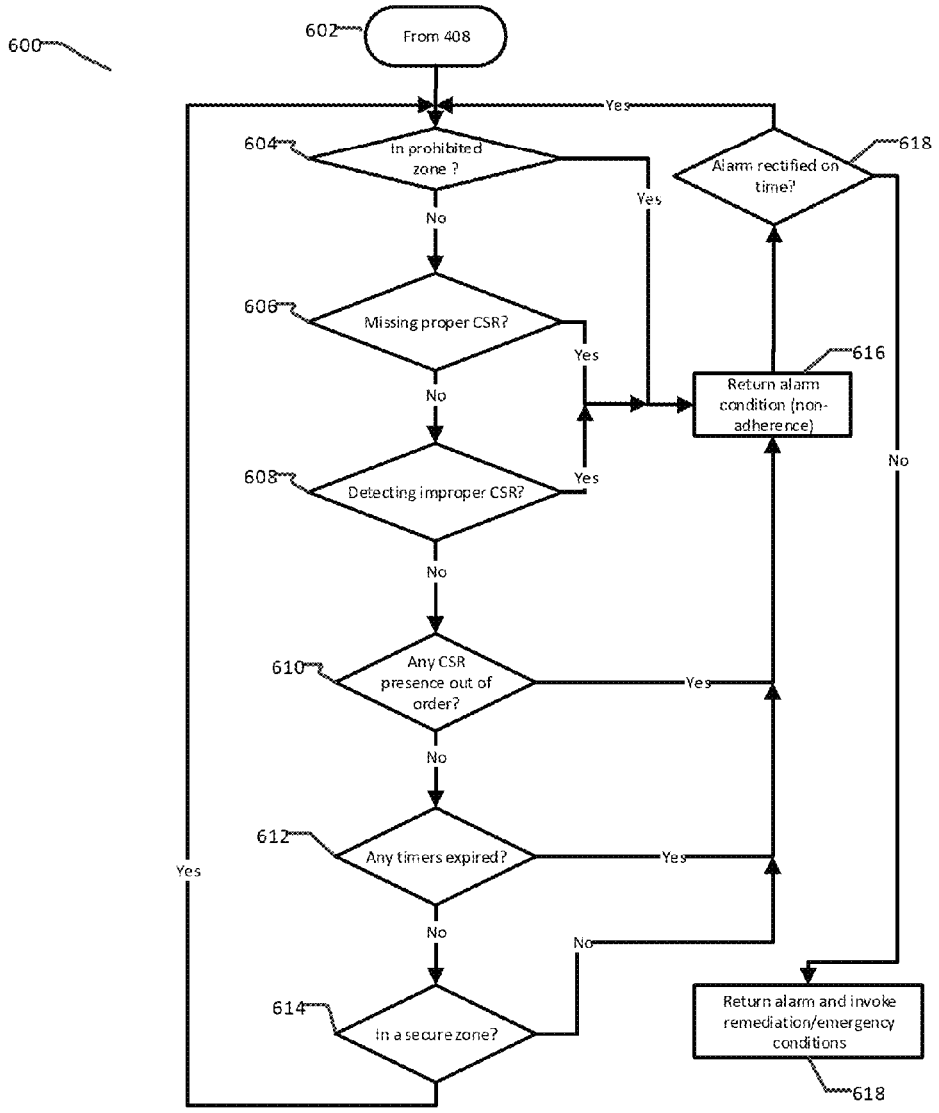
FIG. 6 shows a method for implementing cashbox alarms for monitoring and/or emptying a cashbox into a vault according to an embodiment of the invention.

FIG. 6 shows a method 600 for implementing cashbox alarms for monitoring and/or emptying a cashbox into a vault according to an embodiment of the invention.

Method 600 may operate substantially continuously from the time a particular cashbox 36 is to be monitored (as initiated by one or more monitoring triggers as described herein) until, for example, a monitoring completed trigger occurs (such as cashbox 36 being emptied into vault 22 and/or its cash present flag being reset, and as otherwise described herein). Method 600 may be performed by monitoring system 44, MDT 40, gateways 38*b* and the like, alone or together, with various aspects handling various portions and communicating therebetween.

Turning to method 600 it begins from 408 at 602 and continues to 604 to query whether cashbox 36 (and hence tag 32) is in a prohibited zone. If so method 600 proceeds to 616. If not, method 600 proceeds to 606.

At 606 method 600 queries whether cashbox 36 is missing a proper CST. If so method 600 proceeds to 616. If not, method 600 proceeds to 608. Missing a proper CST may include: missing the presence of a Handler, having missed an entrance CST (which may not be a problem but may cause confusion and require an alarm to resolve), and the like.

At 608 method 600 queries whether any improper CSTs are detected. If so method 600 proceeds to 616. If not, method 600 proceeds to 610. Detecting an improper CST may include: detecting being in an alarm or prohibited zone, being close to a checkpoint, and the like.

At 610 method 600 queries whether any CST being detected is out of order. If so method 600 proceeds to 616. If not, method 600 proceeds to 612. Detecting a CST out of order may include: detecting a CST along a secure pathway before an earlier CST is detected (ie a CST was skipped), a CST in a secure zone is detected without an entrance CST being detected, a vehicle CST not being detected before a bay 14 CST is detected, detecting a secure pathway CST before a Handler CST is detected, and the like. There is no particular limitation to what ordering and sequencing may be applied and may be appropriate for a particular monitoring and deposit implementation, and the like.

At 612 method 600 queries whether any timers have expired. If so method 600 proceeds to 616. If not, method 600 proceeds to 614. Timers may include: overall timers to get cashbox 36 emptied, timers along secure pathway 24*c* (ie every 30 seconds a new CST should be detected), excessive time where a Handler is unsuccessfully trying to remove cashbox 36, and the like.

At 614 method 600 queries whether cashbox 36 is in a secure zone. If not method 600 proceeds to 616. If so, method 600 returns to 602 to continue monitoring.

Returning to 616, if the result of any queries lead to 616 then the alarm is returned and provided, as required. This may have any number of effects, not limited to: communicating with Handler, shutting exits 28 and entrances 26, audible or visual warnings, dispatching security, and the like. These measures may all be taken to prevent loss and to get cashbox 36 moving effectively again.

After 616 method 600 continues to query, at 618, whether the alarm has been dealt with on time and/or effectively. Clearly this will depend on the nature of the alarm(s). For example, a Handler may quicken their pace so timers are reset and no longer are a problem, Handler CST may be detected (they had dropped their badge), and the like. Of course certain alarms (near an exit 28 for example) might not lead to delays for rectification though monitoring may be recommenced after a security intercept for example.

It is to be understood that all of 604/606/608/610/612/614 are depicted as separate, in parallel, and ordered. They need not be any of those things. Further, one may trump another (ie lack of Handler CST may be trumped, and thus no alarm returned, if cashbox 36 is in a secure zone 22—depending on the implementation and preferences of the system users and owners). Each of these permutations are considered within the scope of the present invention.

This concludes the description of the presently preferred embodiments of the invention. The foregoing description has been presented for the purpose of illustration and is not intended to be exhaustive or to limit the invention to the precise form disclosed. It is intended the scope of the invention be limited not by this description but by the claims that follow.

What is claimed is:

1. A system for secure cashbox removal from a transit vehicle and emptying in a vault at a transit site, the system comprising:

a cashbox, removably attached to a transit vehicle driven by a transit operator, that receives cash from one or more riders during operation of the transit vehicle and can be removed from the transit vehicle and taken to a vault to deposit the cash located in the cashbox, the cashbox comprising a cashbox tag configured to:

broadcast a cashbox tag present signal;

one or more secure zones inside the transit site, created and defined by one or more cashbox signal transceivers, the one or more cashbox signal transceivers defining the one or more secure zones configured to:

receive the cashbox tag present signal if the cashbox is within communicable range of the one or more secure zones; and communicate the one or more secure zone signals, representing the presence of the cashbox in the one or more secure zones, to a monitoring system if the cashbox tag present signal is received;

one or more alarm zones inside the transit site, created and defined by the one or more cashbox signal transceivers, the one or more cashbox signal transceivers defining the alarm zones configured to:

obtain a cashbox tag present signal if the cashbox is within communicable range of the alarm zone; and provide one or more alarm zone signals, representing the presence of the cashbox in the alarm zone, to the monitoring system if the cashbox tag present signal is obtained;

the monitoring system for a transit site, the monitoring system configured to:

accept the one or more alarm zone signals and the one or more secure zone signals;

determine, using the one or more alarm zone signals and the one or more secure zone signals, whether any cashbox rules have been violated; and trigger a cashbox alarm if any of the cashbox rules have been violated; and a vault, located at the site, for accepting a deposit of the cash from the cashbox.

2. The system of claim 1 wherein the cashbox rules comprise cashbox tracking rules and cashbox monitoring rules and the cashbox alarms comprise cashbox tracking alarms and cashbox monitoring alarms.

3. The system of claim 2 wherein the secure zone signal includes a cashbox signal transceiver identifier and a timestamp of when the cashbox tag present signal was received by the cashbox signal transceiver.

4. The system of claim 3 further comprising a first secure zone that is a secure pathway and the monitoring system receives a first set of secure zone signals from the cashbox signal transceivers in the secure pathway as the cashbox is moved towards the vault, and determines whether any cashbox tracking rules have been violated based on the cashbox signal transceiver identifiers and timestamps of the first set of secure zone signals.

5. The system of claim 1 wherein the cashbox tag further comprises a cash present flag that indicates whether there is cash in the cashbox.

6. The system of claim 5 wherein the cash present flag is set to true when cash is received by the cashbox and is set to false when a deposit from the cashbox is received by the vault.

7. The system of claim 6 wherein the cashbox alarms are deactivated when the cash present flag is set to false.

8. The system of claim 1 wherein the cashbox is removable when one or more cashbox removal conditions are met.

9. The system of claim 8 wherein the one or more cashbox removal conditions comprise:

the presence of one or more mechanical keys or one or more electronic keys;

the presence of an authorized handler.

10. The system of claim 9 wherein the one or more cashbox removal conditions further comprise:

the cashbox tag does not receive any alarm zone present signal;

and the cashbox tag receives at least one secure zone present signal.

11. The system of claim 1 wherein the monitoring system is further configured to:

receive one or more handler signals;

determine, using the one or more handler signals, the one or more alarm zone signals, and the one or more secure zone signals, whether any handler rules have been violated; and trigger a handler alarm if any handler rules have been violated.

12. A method for securely removing a cashbox from a transit vehicle and emptying in a vault at a transit site, the method comprising:

removing the cashbox from the transit vehicle;

broadcasting a cashbox tag present signal;

receiving the cashbox tag present signal if the cashbox is within a communicable range of a secure zone; and communicating one or more secure zone signals, representing the presence of the cashbox in the secure zone, to a monitoring system if the cashbox tag present signal is received;

obtaining a cashbox tag present signal if the cashbox is within communicable range of an alarm zone;

providing one or more alarm zone signals, representing the presence of the cashbox in the alarm zone, to the monitoring system if the cashbox tag present signal is obtained;

accepting the one or more alarm zone signals and the one or more secure zone signals;

determining, using the one or more alarm zone signals and the one or more secure zone signals, whether any cashbox rules have been violated; and triggering a cashbox alarm if any cashbox rules have been violated.

13. The method of claim 12 wherein the cashbox rules comprise cashbox tracking rules and cashbox monitoring rules and the cashbox alarms comprise cashbox tracking alarms and cashbox monitoring alarms.

14. The method of claim 12 wherein the secure zone signal includes a cashbox signal transceiver identifier of a cashbox signal transceiver that received the cashbox tag present signal and a timestamp of when the cashbox tag present signal was received by the cashbox signal transceiver.

15. The method of claim 14 wherein the secure zone is a secure pathway and the one or more secure zone signals comprises a first set of secure zone signals from the cashbox signal transceivers in the secure pathway as the cashbox is moved towards the vault.

16. The method of claim 12 further comprising setting a cash present flag to true when cash is received by the cashbox and to false when a deposit from the cashbox is received by the vault.

17. The method of claim 16 further comprising deactivating the cashbox alarms when the cash present flag is set to false.

18. The method of claim 12 wherein the removing further comprises checking that one or more cashbox removal conditions are met.

19. The method of claim 18 wherein the one or more cashbox removal conditions comprise:

the presence of one or more mechanical keys or one or more electronic keys;

the presence of an authorized handler.

20. The method of claim 19 wherein the one or more cashbox removal conditions further comprise:

the cashbox tag does not receive any alarm zone present signal; and the cashbox tag receives at least one secure zone present signal.

21. The method of claim 12 further comprising:

getting one or more handler signals;

deciding, using the one or more handler signals, the one or more alarm zone signals, and the one or more secure zone signals, whether any handler rules have been violated; and raising a handler alarm if any handler rules have been violated.

* * * * *